United States Patent [19]

Barry et al.

[11] 4,352,082

[45] Sep. 28, 1982

[54] THERMAL FUSE

[75] Inventors: Leon G. Barry; Willis E. Rieman, both of Shelby, N.C.

[73] Assignee: Fasco Industries, Inc., Boca Raton, Fla.

[21] Appl. No.: 238,018

[22] Filed: Feb. 25, 1981

[51] Int. Cl.[3] ..... H01H 37/76

[52] U.S. Cl. ..... 337/409

[58] Field of Search ..... 337/409, 408, 407

[56] References Cited

U.S. PATENT DOCUMENTS 3,155,800 11/1964 Denton ..... 337/409

4,030,061 6/1977 Gaskell et al. ..... 337/409

*Primary Examiner*—Harold Broome

*Attorney, Agent, or Firm*—Shlesinger, Fitzsimmons & Shlesinger

[57] ABSTRACT

A one-piece wire lead has intermediate its ends a thin, flattened section which is seated against a recessed die surface that is formed on one end wall of a hermetically sealed chamber in a preferably transparent, paraboloidally-shaped plastic housing. The two cylindrical leg sections of the lead project out of the opposite end of the chamber for connection in series with a conductor in a circuit that is to be protected. A plastic, electrically non-conductive, spring-loaded sabot is mounted to reciprocate in the chamber between a retracted position in which a sharp cutting edge on the forward end thereof faces one side of the flattened section of the lead, and an advanced position in which the sabot cutting edge has cut through the flattened lead section, and has extended into a recess in the die surface. Normally a compacted, granular thermal plug is cast or molded around either the sharp cutting edge of the sabot, or its operating spring, thereby normally to retain the sabot in its retracted position. When the ambient temperature of the fuse exceeds a predetermined value the plug melts suddenly and permits its spring to drive the sabot cutting edge suddenly through the flattened section of the wire lead completely to sever the lead intermediate its ends.

15 Claims, 10 Drawing Figures

THERMAL FUSE

BACKGROUND OF THE INVENTION

This invention relates to a thermal limiter or fuse of the type which is particularly suitable for use in protecting electrical circuits employed in low power applications, and in confined areas. More specifically, this invention relates to an improved fuse which utilizes a material that fuses or melts at elevated temperatures in order to effect the opening of an electrical circuit.

It has long been customary to employ thermal fuses of the type which rely upon a spring-loaded device to open a circuit once the fuse has been activated or blown. Moreover, it is also conventional to employ a wax-like substance for retaining the spring-loaded device in its cocked or inoperative position, at least until such time that an increase in the ambient temperature causes the substance to melt and release the device, which in turn opens the circuit in which the fuse is connected.

Typically such prior thermal fuses employ some form of butt-type bridging contacts, which are parted by the spring-loaded device when the fuse is activated. All such fuses which employ butt-type contacts have the disadvantage that they are plagued by problems resulting from $I^2R$ losses, which generate undesirable heat. Because of these $I^2R$ losses the cutoff (circuit opening) temperatures may vary not only from fuse to fuse, but also from application to application.

Typical such prior art devices are disclosed in U.S. Pat. Nos. 3,727,164 and 4,145,654. Each employs a meltable pellet for retaining two separate contacts of a switching mechanism in electrical contact with each other until such time that a predetermined ambient temperature has been exceeded. This same principal, of course, may be applied to the normally-open circuit type of switches (see e.g., U.S. Pat. Nos. 4,084,147 and 4,160,968), because the meltable pellet can be used just as effectively to maintain two contacts spaced from one another against the resistance of a spring until the pellet melts. Still further variations of such fuses which employ movable or butt-type contacts can be found in U.S. Pat. Nos. 3,180,958; 3,291,216; 3,291,945 and 3,649,942.

SUMMARY OF THE INVENTION

The disadvantages of prior thermal fuses of the type described have been obviated by employing a novel fuse which exhibits substantially no $I^2R$ losses. This is effected by employing in the circuit that is to be protected, a wire, which is typically round in cross section, except for a portion of which is flattened to a wide, thin ribbon. Although the configuration of the wire differs, its cross-sectional area remains substantially unchanged, and as a consequence, when in use, there are substantially no $I^2R$ losses. The flattened area of the wire is then placed beneath a spring-loaded non-conductive sabot which has a razor-sharp, spear-pointed tip which is pointed directly at the flattened portion of the wire in such a manner that, when the spring-loaded sabot is released, it will instantly cut directly and completely through the flattened area of the wire completely to interrupt the circuit. The sabot is held in its spring-loaded position by means of a thermal fuse pellet which has the property of turning from a solid into a liquid within a very narrow temperature range. By way of example, "Dibenzofuran" is a typical organic chemical which exhibits this particular characteristic. In practice the flattened portion of the wire and the spring-loaded sabot are enclosed in a hermitically sealed housing, which may have a transparent cover section to permit visual examination of the fuse interior.

THE DRAWINGS

DETAILED DESCRIPTION OF THE INVENTION

Figure 1:
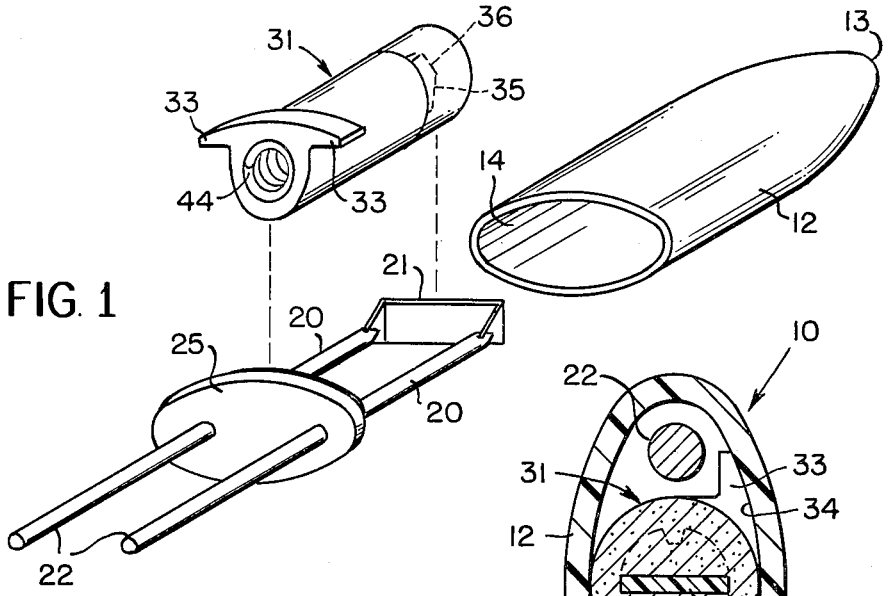
FIG. 1 is an exploded, perspective view of a novel thermal fuse made according to one embodiment of this invention.
Figure 3:
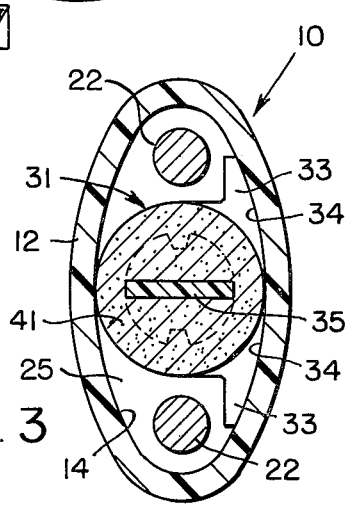
FIG. 3 is a cross sectional view taken along the line 3—3 in FIG. 2 looking in the direction of the arrows.

Referring now to the drawings by numerals of reference, and first to the embodiment illustrated in FIGS. 1 to 3, 10 denotes generally a thermal fuse comprising a generally paraboloidally shaped casing 12 having a rounded, closed end 13, and an axial bore 14 which opens on the opposite end of the casing. The bore 14 is generally oval in cross section and terminates at its inner end on a plane, transverse die surface 16, which has therein a central notch or groove 18 for a purpose noted hereinafter.

Projecting into the casing bore 14 is a generally U-shaped wire lead 20, which is flattened intermediate its ends to form thereon an elongate, thin ribbon section 21. Opposite ends of section 21 are integral with the usual, cylindrically shaped sections or legs 22 of the lead. As shown more clearly in FIG. 2, the lead 20 is bent rearwardly adjacent opposite ends of its ribbon section 21 so that its parallel leg sections 22 project rearwardly in bore 14 and through registering openings 24 that are formed in an oval base plate or cap 25, which is secured in and seals the open end of casing 12. The cap 25 has a reduced-diameter section 26 which projects snugly into the casing bore 14. Since it is desirable that the interior of fuse 10 be hermetically sealed, it is preferred that the legs 22 of the wire lead 20 be molded sealingly into the openings 24 in the cap 25, and that the projection 26 on the cap 25 be ultrasonically welded or otherwise secured sealingly to the surrounding bore wall.

The U-shaped wire lead 20 is thus supported rigidly in the bore 14 of casing 12 with its ribbon section 21 seated against the die surface 16, and extending transversely across the die groove 18 and parallel to the major diameter of the bore 14.

Figure 2:
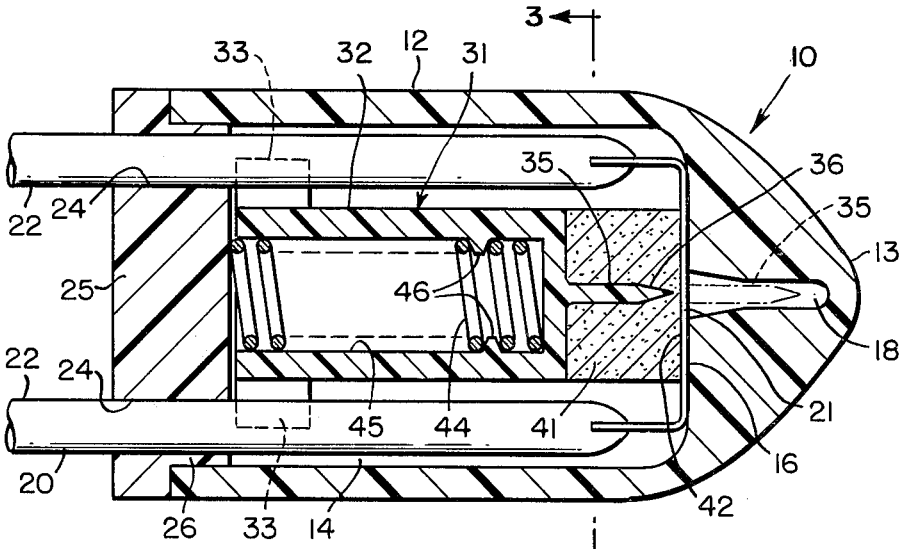
FIG. 2 is a longitudinal sectional view taken through the center of this fuse as it appears when finally assembled.

Mounted in the sealed bore 14 of casing 12 for reciprocation axially thereof between the legs 22 of lead 20 is a plastic sabot 31, which is made from an electrically non-conductive, plastic material. Sabot 31 has a cylindrical body section 32, the outside diameter of which is slightly less than the major diameter of the oval-shaped bore 14. Adjacent one end thereof (the left end in FIG. 2) the body section 32 has thereon a pair of integral, winged-shaped projections 33 having curved outer surfaces 34 that are slidably engageable with one side of the wall of bore 14 to prevent any rotation of the sabot 31 relative to casing 12. Integral with, and projecting from the opposite end of the sabot section 32 centrally thereof is a relatively thin, spear-shaped blade or projection 35, which registers with the groove 18 in the closed end of casing 12. This projection has formed thereon a sharp cutting edge 36 which extends transversely of the ribbon section 21 of the lead 20, and which is positioned in confronting relation to its inner or left hand surface as shown in FIG. 2.

Molded or precast onto the right end of the sabot 31 to surround its spear-shaped projection 35 is a cylindrical plug or body 41 of a compacted granular thermal fuse material, such as for example the type known as "Dibenzofuran". This plug 41 completely encloses the blade section 35 and has formed on its outer end a plane, flat surface 42, which is held in coplanar engagement with the inside surface of the lead section 21 by means of a coiled compression spring 44. This spring is housed in an axial bore 45, which is formed in the end of the cylindrical sabot section 32 remote from its blade 35. Spring 44, which is slightly compressed as illustrated in FIG. 2, is engaged at its end remote from the sabot blade 35 with the inside surface of the cap 25, whereby it urges the sabot toward the right in FIG. 2, and consequently urges the plane surface 42 on the plug 41 resiliently against the ribbon section 21 of the lead wire.

To retain the spring 44 in the bore 45 of the sabot, two diametrally opposed projections 46 are formed on the wall of bore 45, and project slightly radially into the bore and between adjacent coil windings on the spring releasably to hold it in bore 45 during assembly of the fuse.

In use, the two leg sections 22 of the wire lead are connected at the exterior of the fuse in series circuit with a current carrying wire in an electrical circuit which is to be protected, for example a motor transformer winding. Then, if because of a mechanical or electrical fault or the like, the ambient temperature of the fuse 10 is caused to rise above a predetermined value, the thermal fuse plug 41 will melt suddenly, and will allow the compressed spring 44 to expand suddenly and to drive the razor-sharp edge 36 of the sabot suddenly through the ribbon section 21 into its circuit-opening position as shown by broken lines in FIG. 2. In this position the blade section 35 of the sabot projects into the recess 18 in the nose of casing 12, thereby completely separating the ribbon section 21 intermediate its ends and opening the electrical circuit in which the fuse is connected.

One of the advantages of the herein disclosed fuse is that, at least in those cases where low temperature plastics are employed, the housing 12 can be made transparent so that one can readily observe whether or not the fuse 10 has blown. More importantly, by using a one-piece, uninterrupted wire conductor or lead it has been possible substantially to eliminate the undesirable $I^2R$ losses which are so common to fuses which employ the butt-type bridging contacts. By eliminating such heat losses it is possible to maintain within a few degrees the critical temperature at which the fuse plug 41 will melt suddenly. This construction also eliminates the objectionable electrical "noise" which occurs in fuses with the butt-type electrical contacts because of changes in the contact resistance during use.

As previously noted, the material employed for molding the plug 41 has the property of turning from a solid into a liquid within a very narrow temperature range. In addition to the above-noted "Dibenzofuran" there are a number of other known fuse materials which can be employed, for example other types of compacted granular materials or wax-like varieties, and which are designed to melt suddenly at predetermined temperature levels. By selecting the proper fusing material and tension in spring 44, it is therefore possible to design the fuse 10 quickly to open a circuit wherever the ambient temperature of the fuse reaches a predetermined value.

Although a principal feature of this invention is to employ a one-piece conductor which is flattened at the point where it is to be broken, and although this flattening operation obviously changes the configuration of the wire lead 20 intermediate its ends, the cross sectional area of the wire nevertheless remains substantially unchanged throughout the length of the lead, including both its flat and cylindrical sections. It is because of this, and because there are no electrical intermediates, or contact bridges through which currents must flow, that the lead exhibits substantially no $I^2R$ losses and consequent heat generation.

The sharp, spear-pointed cutting edge 36 of the sabot is constructed to have an overall width slightly greater than the width of the flattened section 21 of the lead 20 (see for example the hereinafter described FIGS. 6 and 7), so that when the sabot is released it cuts rapidly and completely through section 21, thereby completely separating this section and preventing any further current flow through the lead 20. Since the compression spring 44 is compressed slightly at the time of its assembly into the fuse casing 12, it secures all of the interconnected parts against any undesirable movement one relative to the other until such time that the fuse is blown. The wings 33 on the sabot section 32 have sliding engagement with the bore wall 14 of the housing 12, when the sabot shifts from its retracted to its circuit-interrupting position, thereby preventing any undesirable rotation of the sabot in the housing, and thus maintaining the spear section 35 in parallel registry with slot 18 in the die surface 16.

Figure 4:
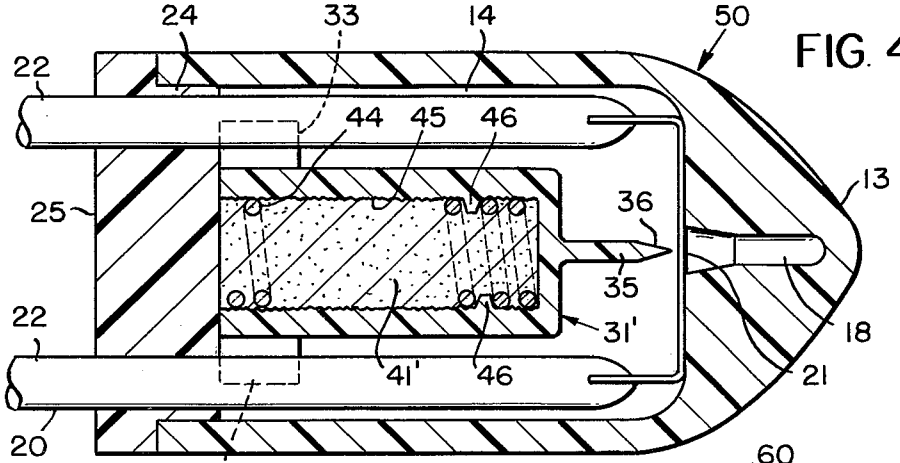
FIG. 4 is a longitudinal sectional view taken through the center of a modified form of this fuse.

A modified from of this fuse is denoted generally at 50 in FIG. 4, wherein like numerals are employed to denote elements similar to those employed in the first embodiment. This modified form of the fuse is generally similar to that shown in FIGS. 1 to 3, except that instead of being molded or precast around the spear tip section 35 of the sabot 31' the compacted fuse pellet 41' is molded in the bore 45 of the sabot so as completely to surround the exposed surfaces of the compression spring 44. This maintains the spring in its compressed state until such time that the plug 41' is caused to melt. At that time the sharp edge 36 of the spear section 35, which, as in the case of the first embodiment, is normally positioned in confronting relation to the inside surface of the flat section 21 of the wire lead, will be suddenly released and will cut completely through section 21 and enter the groove 18 in the surface 16, thereby to sever section 21 into two separate parts and to interrupt any current flow in the lead.

In this second embodiment it may be desirable to employ a rough surface on the bore wall 45 so as to enable the compacted plug 41' to grip and remain snugly in the bore at the time that the spring 44 is assembled in its compressed state into the sabot. One way of doing this would be to employ an internally threaded bore wall in the sabot 31+, or any form of axially spaced grooves or recesses in the inside surface of the bore 45.

Figure 6:
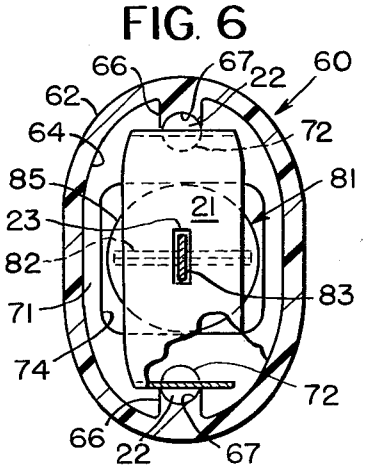
FIGS. 6 and 7 are sectional views taken generally along the line 6—6 in FIG. 5 and showing the flattened wire section of this third embodiment before and after, respectively, being punctured by a sabot.
Figure 7:
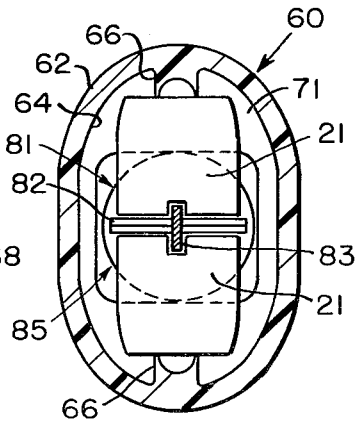
Figure 5:
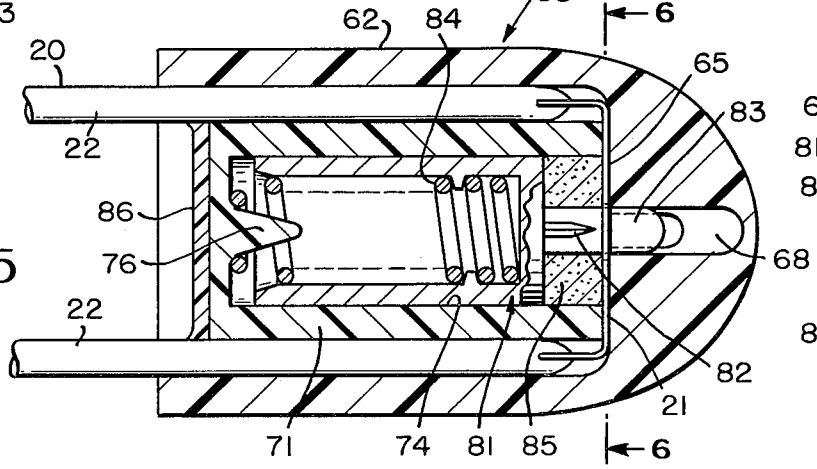
FIG. 5 is a longitudinal sectional view taken through the center of a third embodiment of this fuse.

Still another embodiment of this invention is denoted generally at 60 in FIGS. 5 to 7, wherein like numerals are again employed to denote elements similar to those employed in the first two embodiments. In this embodiment the fuse casing 62 is generally paraboloidal in configuration and is made from a transparent plastic material. It surrounds a similarly shaped base member 71, which has in its outer surface a pair of opposed, longitudinally extending grooves 72 that confront upon arcuate recesses 67 that are formed in the confronting surfaces of a pair of lands 66 that project from the inside surface of the casing bore 64 at diametrally opposite sides thereof. The U-shaped lead 20 has its flat section 21 secured by the inner end of member 71 against a recessed die surface 65 at the bottom of bore 64, and has its leg sections 22 projecting rearwardly through the registering recesses 67, 72 to the exterior of the fuse.

Member 71 has therein a rectangular bore 74, which is closed at one end (its end in FIG. 5), and which opens at its opposite end on the inside surface of the ribbon section 21. Axially slidable in member 71 is a cylindrically shaped, hollow sabot 81, which has an open end facing the closed end of member 71. Integral with the forward, or closed end of sabot 81 is a thin, spear-shaped projection 82, which has its sharp edges positioned in transverse confronting relation to the flattened wire section 21. Projecting from the center of the spear section 82 is a flat nose or guide 83 which extends through a central slot 23 in the ribbon section 21 and into a registering recess 68 formed in the rounded nose section of casing 62.

Mounted within the bore of sabot 81 is a coiled compression spring 84, which is seated at one end on the closed end of the sabot, and at its opposite ends surrounds a centering lug 76 that projects centrally from the closed end of member 71. The spring 84 is held within the sabot 81 in a slightly compressed condition by means of a cylindrical fuse pellet 85, which is cast or molded in the open end of member 71, and around the spear-shaped projection 82, normally to secure the sabot 81 against axial movement of the bore of member 71.

Member 71 and the sabot 81 are sealed within the bore 64 of casing 62 by means of an apoxy end seal 86, of the like, which is molded or otherwise formed in the open end of bore 64 after assembly of the fuse.

In use, the lead 20 is connected in series with a conductor in an electrical circuit, and when the ambient temperature exceeds a predetermined value the plug or pellet 85 melts suddenly and permits the compressed spring 84 to drive the sharp edge of the spear section 82 through the flat ribbon section 21, and into the recess 68 in the die surface 65, thereby completely to separate section 21 intermediate its ends, as shown more clearly in FIG. 7. During this movement the projection 83 prevents any undesirable rotation of the sabot; and the piston action of the spring-driven member 71 forces the melted pellet material rearwardly in the bore 74 in member 71 around the outside of the sabot 81, so that the melted pellet does not interfere with the advance of the sabot toward the right in FIG. 5.

In the embodiment shown in FIGS. 8–10, 90 denotes generally a fuse comprising a transparent, rectangularly shaped casing 92 having a rectangular bore 91 terminating at the closed end of the casing on a flat die surface 93 which is slotted as at 94. In this embodiment the flat section 21 of a wire lead 20 is placed against the die surface 93 substantially to close the slot 94, after which a meltable fuse pellet 95 is compacted and molded to the casing 92 at the bottom of its bore 91, and over the flat wire section 21.

The pellet 95 has formed in its outer face a transverse slot or recess 96 for accommodating the sharp, spear shaped end 97 of a cylindrical sabot 98, which is axially slidable in the casing bore 91. As in the preceding embodiment, the sabot 98 contains a compression spring 99, which is held in a compressed state by a rectangular cap or cover 101, which is sealingly secured by ultrasonic welding, or the like, in the open end of casing 92 beneath an epoxy seal 102.

In this embodiment a pair of grooved lands 104 project from diametrally opposite sides of the sabot and slidably into a pair of registering, axially extending grooves 105 formed in opposite sides of the casing bore 91. In a manner similar to the preceding embodiment each leg 22 of lead 20 extends rearwardly in bore 91 and through the space formed by a pair of grooved surfaces 104, 105 to the exterior of the casing. In this embodiment, therefore, the sabot 98 is guided against rotation on bore 91 by virtue of the sliding engagement of it grooved lands 104 in the elongate grooves 105 in casing 92.

Figure 8:
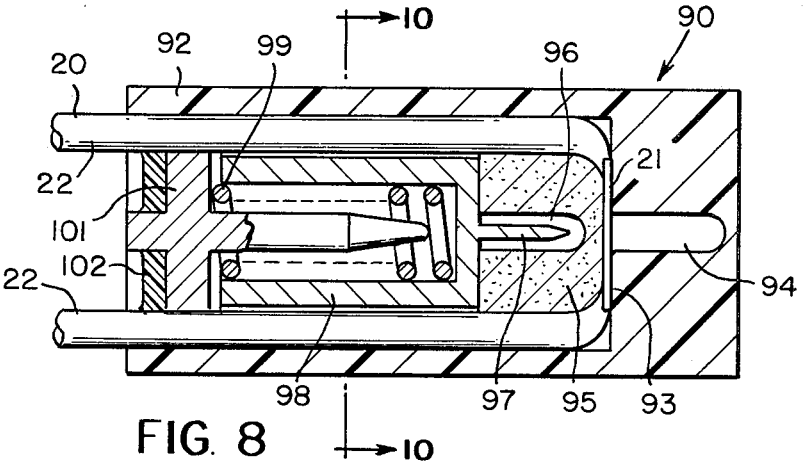
FIGS. 8 and 9 are longitudinal sectional views taken at right angles to each other through the center of still another form of this fuse.
Figure 9:
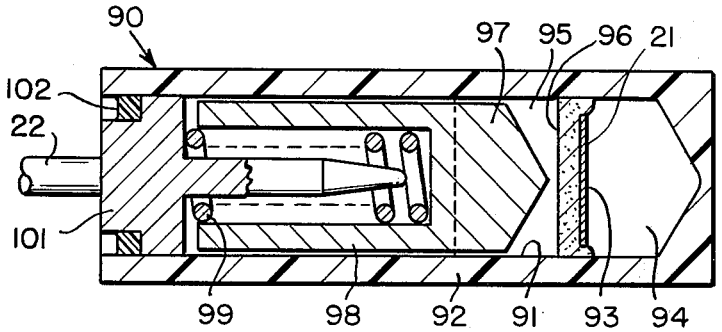
Figure 10:
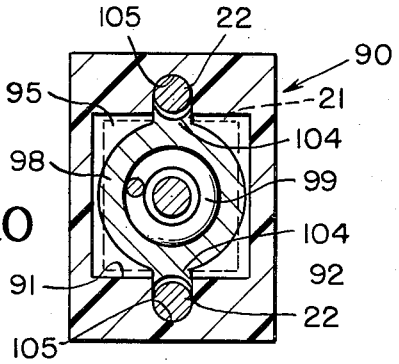
FIG. 10 is a sectional view taken along the line 10—10 in FIG. 8.

As shown in FIGS. 8 and 9, the spring 99 urges the pointed end of sabot 98 resiliently against the plane, outer surface of pellet 95, and with the spear head 97 of the sabot projecting into the slot 96 in the pellet. Consequently, when pellet 95 melts, the sharp tip of the sabot will be driven suddenly through the flat wire section 21 and into the recess 94, thereby cutting off any current flow through lead 20.

From the foregoing it will be apparent that the instant invention provides a relatively simple, inexpensive and extremely reliable means for opening or interrupting the current flow in an electrical circuit when the ambient temperature thereof exceeds a predetermined value. By maintaining the cross sectional area of the lead 20 substantially constant it is possible substantially to eliminate any $I^2R$ losses heretofore encountered with prior such fuses, and thereby substantially to increase the accuracy and reliability of the fuse. Moreover, since these novel fuses eliminate the need for employing any electrical intermediates, such as butt-type bridging contacts and the like, it is possible substantially to reduce the overall cost of the fuse. Also, since the section of the one-piece lead which is to be separated can be made very thin, for example on the order of 0.002 inches for a wire size of for example 0.025 inch (diameter), it is possible to employ relatively inexpensive and light plastic parts for effecting the actual serving of the wires when the fuse blows.

Furthermore, while rectangular and paraboloidally-shaped fuse housings have been suggested, it will be apparent that housings having other configurations may be employed without departing from this invention. Also, while it has been suggested that the thermal pellet be molded to the sabot itself, or to the casing, it will be apparent that it may be molded or cast separately and placed between the sabot and the associated die surface, if desired.

Moreover, while this invention has been illustrated and described in detail in connection with only certain embodiments thereof, it will be apparent that it is capable of still further modification, and that this application is intended to cover any such modifications as may fall within the scope of one skilled in the art, or the appended claims.

What we claim is:

1. A thermal fuse, comprising a housing having therein a sealed chamber, a wire lead extending through said housing and having intermediate its ends a thin, flattened section disposed in said chamber, means supporting one side of said flattened section of the lead in confronting relation to a recessed die surface formed in one wall of said chamber, an electrically non-conductive sabot having thereon a sharp cutting edge, and mounted at the opposite side of said flattened section of the lead for movement in said chamber between a first position in which said cutting edge faces said opposite side of flattened section of the lead, and a second position in which said cutting edge is seated in a recess in said die surface, temperature-responsive means connected to said sabot releasably to retain the sabot in said first position, when the ambient temperature of the fuse is below a predetermined value, and means for driving said sabot suddenly into its second position, when the ambient temperature of the fuse exceeds said predetermined value, whereby during travel of the sabot from its first to its second position the cutting edge thereon serves completely through said flattened section of said lead, said wire lead, including said flattened section thereof, being of substantially the same cross sectional area throughout its length.

2. A thermal fuse as defined in claim 1, wherein said driving means comprises a spring connected to said sabot and urging said sabot resiliently toward its second position, and said temperature-responsive means comprises a normally solid thermal material operatively interposed between said spring and said die surface normally to resist movement of said sabot to said second position, and operative when said ambient temperature exceeds said predetermined value, to melt suddenly and to permit said spring to drive said sabot suddenly from its first to its second position.

3. A thermal fuse as defined in claim 2, wherein said thermal material in its solid form is a pellet positioned between said sabot and said opposite side of said flattened section of said lead thereby to retain said sabot in its first position until said material is melted.

4. A thermal fuse comprising a one-piece wire lead having intermediate its ends a thin, flattened section, means supporting one side of said flattened section of the lead in confronting relation to a recessed die surface, an electrically non-conductive sabot having thereon a sharp cutting edge, and mounted at the opposite side of said flattened section of the lead for movement between a first position in which said cutting edge faces said opposite side of said flattened section of the lead, and a second position in which said cutting edge is seated in a recess in said die surface, temperature-responsive means connected to said sabot releasably to retain the sabot in said first position, when the ambient temperature of the fuse is below a predetermined value, and means for driving said sabot suddenly into its second position, when the ambient temperature of the fuse exceeds said predetermined value, whereby during travel of the sabot from its first to its second position the cutting edge thereon severs completely through said flattened section of said lead, said driving means comprising a spring connected to said sabot and urging said sabot resiliently toward its second position, and said temperature-responsive means comprising a normally solid thermal material operatively connected to said sabot normally to resist movement thereof to said second position, and operative when said ambient temperature exceeds said predetermined value, to melt suddenly and to permit said spring to drive said sabot suddenly from its first to its second position, said thermal material being molded in solid form in a recess in said sabot, and said spring being embedded in a compressed condition in said molded thermal material, and remaining in its compressed condition until said material is melted.

5. A thermal fuse comprising a one-piece wire lead having intermediate its ends a thin, flattened section, means supporting one side of said flattened section of the lead in confronting relation to a recessed die surface, an electrically non-conductive sabot having thereon a sharp cutting edge, and mounted at the opposite side of said flattened section of the lead for movement between a first position in which said cutting edge faces said opposite side of said flattened section of the lead, and a second position in which said cutting edge is seated in a recess in said die surface, temperature-responsive means connected to said sabot releasably to retain the sabot in said first position when the ambient temperature of the fuse is below a predetermined value, and means for driving said sabot suddenly into its second position, when the ambient temperature of the fuse exceeds said predetermined value, whereby during travel of the sabot from its first to its second position the cutting edge thereon severs completely through said flattened section of said lead, said wire lead being generally U-shaped in configuration and comprising two cylindrical leg sections interconnected at one end each by said flattened section of the lead, said supporting means comprising a housing having therein a sealed chamber and having said recessed die surface formed on the wall of said chamber adjacent one end thereof, and said lead being secured in said chamber with said flattened section thereof engaging said die surface on the chamber wall, and with said leg sections thereof projecting out of said sealed chamber to the exterior of said housing.

6. A thermal fuse as defined in claim 5, wherein the cross sectional area of said lead is substantially constant from one end thereof to the other.

7. A thermal fuse as defined in claim 5, wherein said sabot is mounted in said chamber for limited reciprocation between opposite ends thereof, and with its cutting edge extending transversely of said flattened section of said lead, said driving means is a spring interposed between said sabot and said housing normally to urge said sabot toward said recessed die surface, and said temperature-responsive means is a thermal pellet interposed between said sabot and said housing normally to retain said sabot in a retracted position in said chamber, and operative when said ambient temperature exceeds said predetermined value to melt and permit said spring to move the sabot to an advanced position in which the cutting edge thereof severs through the flattened section of said lead and enters the recess in said die surface.

8. A thermal fuse as defined in claim 7, wherein at least a portion of said housing is transparent to allow visual determination of the position of said sabot.

9. A thermal fuse, comprising a housing, a one-piece wire lead extending intermediate its ends into a sealed chamber in said housing, and having a thin, flattened section thereof seated at one side against a recessed die surface on said housing in said chamber, a non-conductive, spring-loaded member mounted in said chamber in said housing for movement between first and second limit positions, and having thereon a sharp cutting edge disposed to confront said flattened section of said lead at the side thereof opposite said recessed die surface when said member is in one of said limit positions, and a normally solid fuse element engaged with said member an operative to retain said member in said one position, when the ambient temperature of the fuse is below a predetermined value, and to melt suddenly, when said ambient temperature exceeds said predetermined value, thereby to allow said spring-loaded member to shift suddenly to its other limit position and to cause said cutting edge thereon to sever in two said flattened portion of said lead, said wire lead including a pair of cylindrically shaped sections integral with opposite ends, respectively of said flattened section thereof, and extending externally of said housing, and the cross sectional area of said lead being substantially constant from one end thereof to the other, thereby substantially to eliminate any $I^2R$ losses in said fuse.

10. A thermal fuse comprising a housing, a one-piece wire lead extending intermediate its ends into a bore in said housing, and having a thin, flattened section thereof seated at one side against a recessed die surface on said housing, a non-conductive, spring-loaded member mounted in said bore in said housing for movement between first and second limit positions, and having thereon a sharp cutting edge disposed to confront said flattened section of said lead at the side thereof opposite said recessed die surface, when said member is in one of said limit positions, and a normally solid fuse element connected to said member and operative to retain said member in said one position, when the ambient temperature of the fuse is below a predetermined value, and to melt suddenly, when said ambient temperature exceeds said predetermined value, thereby to allow said spring-loaded member to shift suddenly to its other limit position and to cause said cutting edge thereon to sever in two said flattened portion of said lead, said bore extending part way only onto said housing, and said recessed die surface being formed on the inside surface of said housing at the bottom of said bore, a cap secured sealingly in the open end of said bore hermetically to seal off the interior of said bore from the atmosphere, and said spring-loaded member being mounted to reciprocate in said sealed bore between a retracted position in which the cutting edge thereon is positioned transversely of said flattened section of the wire lead, and in confronting relation thereto, and an advanced position in which said cutting edge is seated in a recess in said die surface.

11. A thermal fuse as defined in claim 10, wherein said fuse element is in the form of a solid body positioned between said member and said flattened section of said wire.

12. A thermal fuse as defined in claim 10, wherein a spring is interposed between said member and said housing resiliently to urge said member toward its advanced position, and said fuse element is molded to said spring normally to retain the latter in a stressed state, whereby when said fuse element melts said spring returns suddenly to its unstressed state, and in so doing moves said member from its retracted to its advanced position.

13. A thermal fuse as defined in claim 10, wherein said lead is generally U-shaped in configuration, and opposite ends thereof project sealingly through openings in said cap to the exterior of said housing.

14. A thermal fuse as defined in claim 11, wherein said solid body is secured on said spring-loaded member to surround and enclose the cutting edge thereof.

15. A thermal fuse as defined in claim 11, wherein said solid body is compacted into the bottom of said bore around said flattened section of said wire lead and has therein a central recess into which the cutting edge on said member projects.

* * * * *